US005532546A

United States Patent [19]

Horiuchi

[11] Patent Number: 5,532,546

[45] Date of Patent: Jul. 2, 1996

[54] COLOR SELECTING ELECTRODE MOUNTING FRAME FOR CRT AND PROCESS FOR PRODUCTION OF SAME

[75] Inventor: Yoshiro Horiuchi, Tokyo, Japan

[73] Assignee: Sony Corporation, Japan

[21] Appl. No.: 307,005

[22] Filed: Sep. 16, 1994

[30] Foreign Application Priority Data

Sep. 27, 1993 [JP] Japan ..... 5-240177

[51] Int. Cl.[6] ..... H01J 29/81

[52] U.S. Cl. ..... 313/407; 313/402

[58] Field of Search ..... 313/402, 404, 313/407, 292; 445/47

[56] References Cited

U.S. PATENT DOCUMENTS

| | | | |
|---|---|---|---|
| 4,286,189 | 8/1981 | Koizumi et al. | 313/407 |
| 4,495,437 | 1/1985 | Kume et al. | 313/407 |
| 5,416,380 | 4/1995 | Horiuchi | 313/407 |
| 5,424,603 | 6/1995 | Van Den Bekeroom | 313/407 |

*Primary Examiner*—Sandra L. O'Shea
*Assistant Examiner*—Vip Patel
*Attorney, Agent, or Firm*—Ronald P. Kananen

[57] ABSTRACT

A color selecting electrode mounting frame of a CRT which eliminates the waste of materials, is easy to process and assemble, and is low cost of production and a process for production of the same. The color selecting electrode mounting frame for a CRT comprises a pair of long members of an L-sectional shape having curved surfaces formed at their top edge portions to which two opposing sides of a color selecting electrode are attached and a pair of short members having end portions joined to the two ends of these long members. The long members are obtained by blanking a plate of a fixed width into an arc shape of a predetermined curvature, then forming this into an L-sectional shape and a curvature matching the panel glass surface of the CRT. The two end portions of the short members are processed to match the curvature of the two end portions of the long members. The end portions of the short members are processed by a twisting, crushing, or shaving process.

6 Claims, 11 Drawing Sheets

PERSPECTIVE VIEW OF FOURTH EMBODIMENT (RELATED ART)

(RELATED ART)

(RELATED ART)

PLANE VIEW OF FIRST EMBODIMENT SEEN FROM TOP

REAR VIEW OF FIRST EMBODIMENT SEEN FROM BOTTOM

VIEW ALONG VII-DIRECTION OF FIG.5

CROSS-SECTIONAL VIEW
ALONG LINE VII-VII OF FIG. 5

VIEW ALONG IX-DIRECTION OF FIG. 5

ENLARGED VIEW OF
CONNECTION PORTION

PERSPECTIVE VIEW OF THIRD EMBODIMENT

PERSPECTIVE VIEW OF FOURTH EMBODIMENT

COLOR SELECTING ELECTRODE MOUNTING FRAME FOR CRT AND PROCESS FOR PRODUCTION OF SAME

BACKGROUND OF THE INVENTION

1. Field of the Invention

The present invention relates to a color selecting electrode mounting frame for a CRT (Cathode Ray Tube) and a process for production of the same.

2. Description of the Related Art

Inside of a CRT, an aperture grille, shadow mask, or other color selecting electrode is placed in front of the fluorescent screen of the panel. The color selecting electrode is attached to a color selecting electrode mounting frame and is positioned with high precision with respect to the electron guns and fluorescent screen.

A color selecting electrode mounting frame according to the prior art is shown in FIG. 1. As shown in FIG. 1, the color selecting electrode mounting frame 2 is comprising a pair of long members 4, 4 and a pair of short members 6, 6 joined to the two end portions of these long members 4, 4.

At the top edge portions of the long members 4, 4 are formed curved surfaces 8, 8 to which two opposing sides of the color selecting electrode 10 are attached. The curved surfaces 8, 8 have curvatures matching with the curvature of the panel glass of the CRT. The color selecting electrode 10 has formed in it apertures 12 for passing the electron beams.

The short members 6, 6 are bent in a substantially U-shape. The short members 6, 6 are bent in a substantially U-shape so as to provide a clearance between the bottom surface of the frame 2 to the color selecting electrode 10.

When producing the color selecting electrode mounting frame 2 of the prior art, the long members 4 and the short members 6 are separately fabricated. When fabricating a long member 4, as shown in FIG. 2A, first an L-sectional shape rod material 14 is produced. This rod material 14 is formed by cold drawing or rolling a circular cross-section rod material.

Next, the rod material 14 is cut into a predetermined length to obtain a long member preform 14*a* of an L-sectional shape. Next, as shown in FIG. 2B, the long member preform 14*a* is set between a punch 16 and a die 18 and formed so as to give it a predetermined curvature. Next, as shown in FIG. 2C, the two end portions of the preform 14*a* are cut off to remove the unnecessary portions 14*b* of excess lengths of 10 to 15 mm and fabricate the long members 4. At the top edge portion of the long member 4, a curved surface 8 for attachment of one side of the color selecting electrode 10 shown in FIG. 1 is formed.

When producing a short member 6 shown in FIG. 1, first, as shown in FIG. 3A, a square sectional shaped rod material 16 is cut into a predetermined length to obtain a short member preform 16*a*. This preform 16*a*, as shown in FIG. 3B, is placed on a roll 22 positioned between a punch 18 and a die 20. The punch 18 is pushed in the direction of the die 20 so as to bend the material into a U-shape.

Next, as shown in FIG. 3C, the two ends of the preform 16*a* are cut off to remove the unnecessary portions 16*b* of the excess lengths. Then, as shown in FIG. 3D, the preform 16*a* is set in an end cutting apparatus 25, where the two end portions of the preform 16*a* are cut by a cutter 24. Slanted surfaces 26 for joining with the long members 4 are formed at the two end portions of the same, thereby producing the short member 6. During this cutting, the unnecessary portions 16*c* are cut off and removed. The slanted mating surfaces 26 are formed since the long member 4 is bent to a predetermined curvature and therefore it is necessary to incline the mating surfaces of the short member 6 to enable joining to the end portions of the same.

After the long members 4 and the short members 6 are fabricated in this way, they are joined by welding as shown in FIG. 1.

However, in such a conventional construction of a color selecting electrode mounting frame 2, there are the problems in production mentioned below.

First, when producing a long member 4, production of the rod material 14 shown in FIG. 2A requires a second processing step of drawing an irregular shape or rolling and therefore the unit cost of the materials becomes higher. Further, the length of the preform 14*a* cut in the step shown in FIG. 2B is made longer than the finished product in consideration of error etc. in the cutting and forming processes. Therefore, there is the problem that, as shown in FIG. 2C, a step of cutting and removing the unnecessary portions 14*b* after the forming process becomes necessary and there is great waste of materials.

Second, when producing the short members 6, as shown in FIG. 3B, the preform 16*a* for the short members 6 is bent to a U-shape using the roll 22, so stabilization of the bending process required that a preform longer than the finished product by about 5 percent be prepared. Therefore, as shown in FIG. 3C, after the bending process, a step of cutting and removing the excess unnecessary portions 16*b* becomes necessary. The unnecessary portions 16*b* become wasted material.

Third, when producing a short member 6, as shown in FIG. 3D, a cutting apparatus 25 is used to shape the end portions of a preform 16*a* to form the slanted mating surface 26, so the steps are complicated and precision of the slanted mating surface is difficult to achieve as well and as a result there is the problem of a higher manufacturing cost overall.

SUMMARY OF THE INVENTION

The present invention was made in consideration of this situation and has as its object the provision of a construction of a color selecting electrode mounting frame of a CRT which eliminates the waste of materials, is easy to process and assemble, and is low in cost of production and a process for production of the same.

To achieve the above-mentioned object, the color selecting electrode mounting frame for a CRT according to the present invention is a color selecting electrode mounting frame for a CRT comprising a pair of long members of a L-sectional shape having curved surfaces formed at their top edge portions to which two opposing sides of a color selecting electrode are attached and a pair of short members having end portions joined to the two ends of these long members, characterized in that said long members are obtained by blanking a plate of a fixed width into an arc shape of a predetermined curvature, then forming this into an L-sectional shape and a curvature matching the panel glass surface of the CRT.

Preferably, bottom edge portions of said long members have formed on them by coining single-sided tapers of not more than 40 percent of the thickness of the long members.

Preferably, step-like projections are formed at the substantial center portions of said short members so as to adjust the heights from said curved surfaces of said long members to the bottom surfaces of the short members.

Preferably, the two end portions of said short members are processed so as to match the curvature of the two end portions of said long members.

Preferably, the end portions of said short members are processed to match the curvature of the two end portions of said long members by any one of a twisting, crushing, and shaving process.

The join surfaces of the above-mentioned long members with the short members may be crushed so as to become smooth, flat surfaces and the two end portions of said short members may be smooth, flat surfaces.

To achieve the above-mentioned object, further, the process for the production of a color selecting electrode mounting frame for a CRT comprises the steps of a step of blanking a plate of a fixed width into an arc of a predetermined curvature to form an arc-shaped member, forming the arc-shaped member into an L-sectional shape and a curvature which matches a panel glass surface of the CRT and forming on the top edge portion a curved surface on which one of the two opposing sides of the color selecting electrode is attached, and arranging a pair of said long members in parallel and joining short members to the bottoms of the two ends so as bridge the ends.

Preferably, the process further comprises a step of coining the bottom edge portions of said long members to form single-sided tapers of not more than 40 percent of the thickness of the long members.

Preferably, the process further comprises a step of forming step-like projections at the substantial center portions of said short members so as to adjust the heights from said curved surfaces to the bottom surfaces of the short members.

Preferably, the process further comprises a step of processing the two end portions of said short members so as to match the curvature of the two end portions of said long members.

Preferably, the process further comprises a step of processing the end portions of said short members to match the curvature of the two end portions of said long members by any one of a twisting, crushing, and shaving process.

The process may further comprises a step of crushing the mating surfaces of said long members with the short members so as to become flat surfaces.

In the color selecting electrode mounting frame according to the present invention, the long members are fabricated by blanking a plate of a fixed width into an arc shape of a predetermined curvature, then forming this into an L-sectional shape and a curvature matching the panel glass surface of the CRT. A plate of a fixed width can be wound in a coil shape in the longitudinal direction. Therefore, it is easy to store and transport. A coiled plate is an inexpensive, general use material, so procurement of materials becomes easy and the time in inventory can be shortened.

The width of the plate is determined by reverse calculation from the length of the finished product long member after the forming process. Therefore, there is no need to cut off any unnecessary portions of excess length after the forming process and there is no waste of material.

Further, in the present invention, in fabricating the short members, there is no need for bending into a substantially U-shape. A step-shaped projection is formed by pressing or rolling etc. or else no projection is formed at all, so it is possible to cut the material to substantially the same length as the finished short members. Therefore, there is no need to cut off and remove any unnecessary lengths in a later process and as a result there is no waste of material.

Further, the end portions of the short members of the present invention have slanted surfaces for joining with the long members formed by a twisting process or shaving process, so compared with the prior art wherein a slanted mating surface was formed by cutting, the precision of the slanted mating surface is improved and, further, the processing work is extremely easy.

That is, according to the present invention, it is possible to greatly reduce the manufacturing costs compared with the prior art. More specifically, it is possible to realize a more than approximately 20 percent reduction in manufacturing costs.

BRIEF DESCRIPTION OF THE DRAWINGS

The above objects and features and other objects and features of the present invention will be more apparent from the following description made with reference to the accompanying drawings, in which.

DESCRIPTION OF THE PREFERRED EMBODIMENTS

Figure 1:
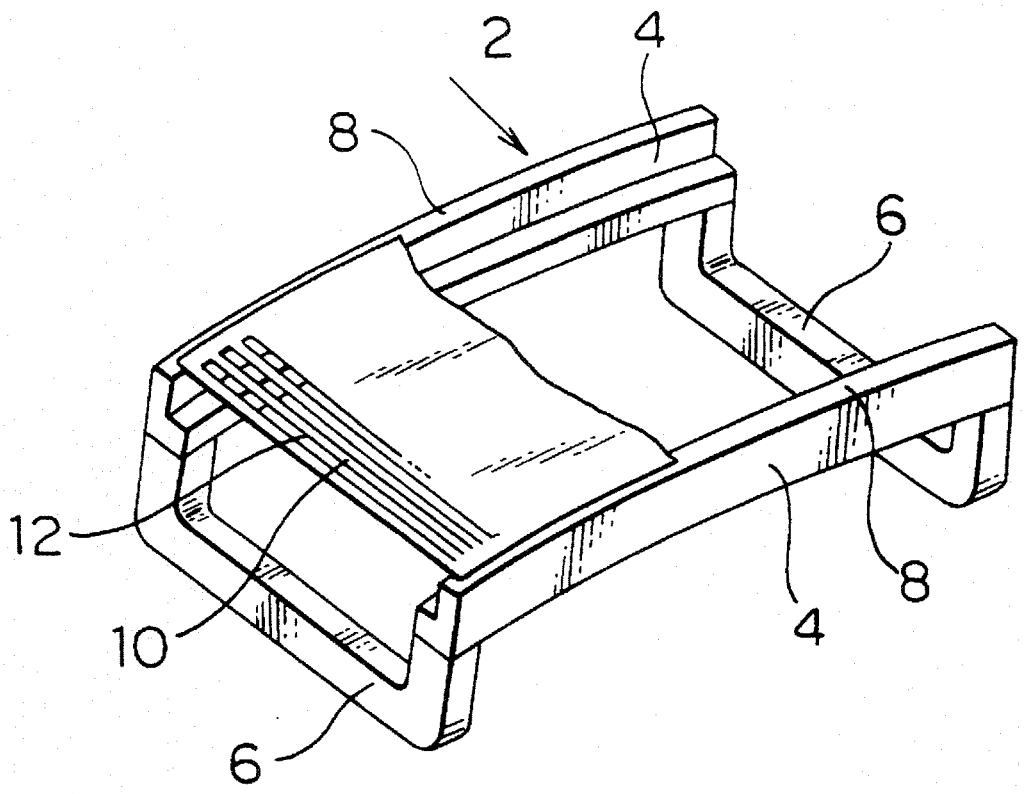
FIG. 1 is a schematic perspective view of a color selecting electrode mounting frame of a CRT according to the related art.
Figure 2A:
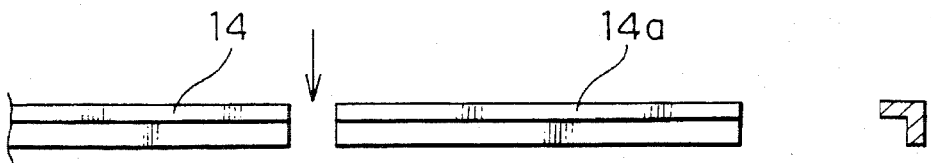
FIGS. 2A to 2C are schematic views showing the steps of production of long members according to the related art.
Figure 2B:
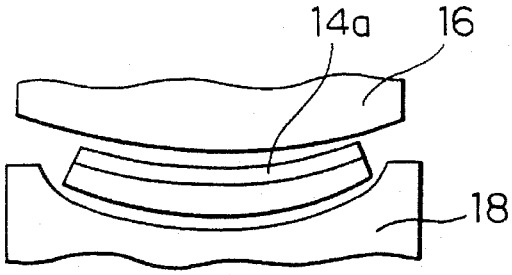
(RELATED ART) FIG. 2B
Figure 2C:
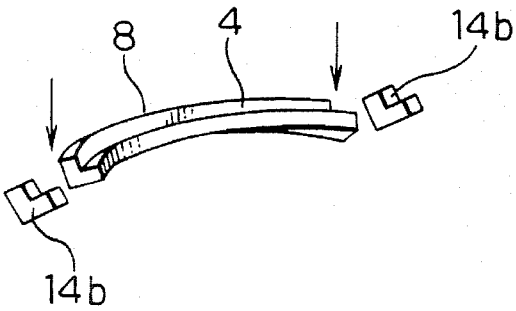
(RELATED ART) FIG. 2C
Figure 3A:
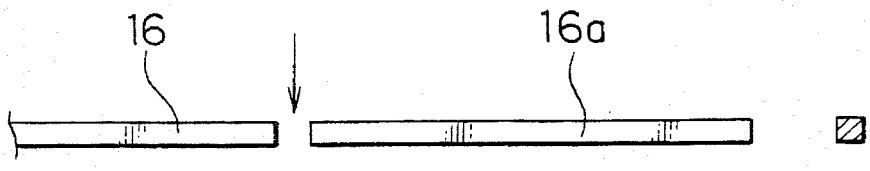
FIGS. 3A to 3D are schematic views showing the steps of production of short members according to the related art.
Figure 3B:
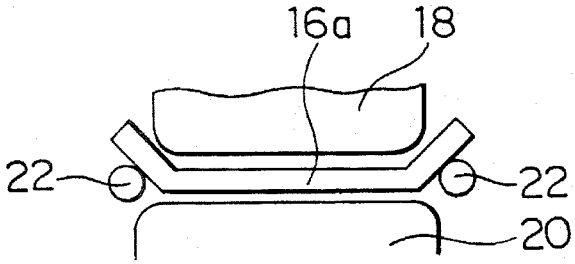
(RELATED ART) FIG. 3B
Figure 3C:
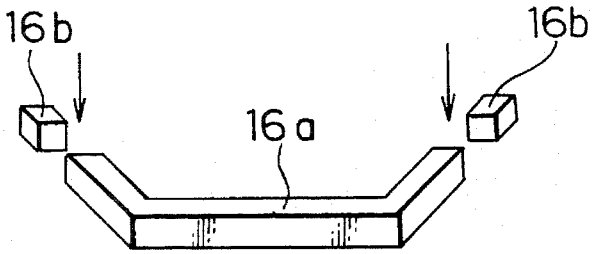
(RELATED ART) FIG. 3C
Figure 3D:
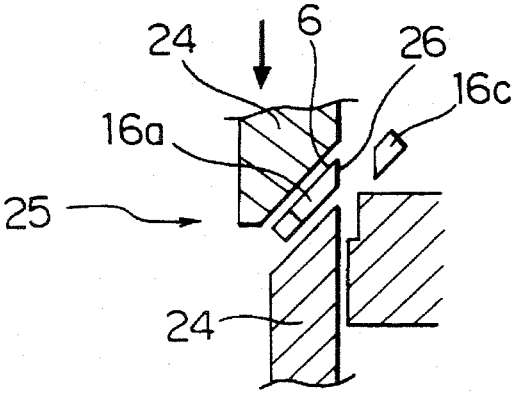
(RELATED ART) FIG. 3D

Below, the color selecting electrode mounting frame according to the present invention will be explained in detail based on the embodiments shown in the drawings.

As shown in FIGS. 4 to 10, the color selecting electrode mounting frame 30 according to the first embodiment of the present invention is provided with a pair of long members 34, 34 and a pair of short members 36, 36 joined to the two end portions of these long members 34, 34. The materials of these members 34 and 36 are not particularly limited, but preferably are materials with linear coefficients of expansion roughly the same as the glass constituting the CRT, for example, are SCM415, SUS403, SUS410, etc. as defined by the JIS.

The long members 34 have a substantially L-shaped cross-section. At the top edge portions are formed curved surfaces 38 and 38 to which two opposing sides of the color selecting electrode 10 are attached. The curved surfaces 38 and 38 have curvatures matching the curvature of the panel glass of the CRT. The color selecting electrode 10 has apertures 12 for passing the electron beams.

Figure 5:
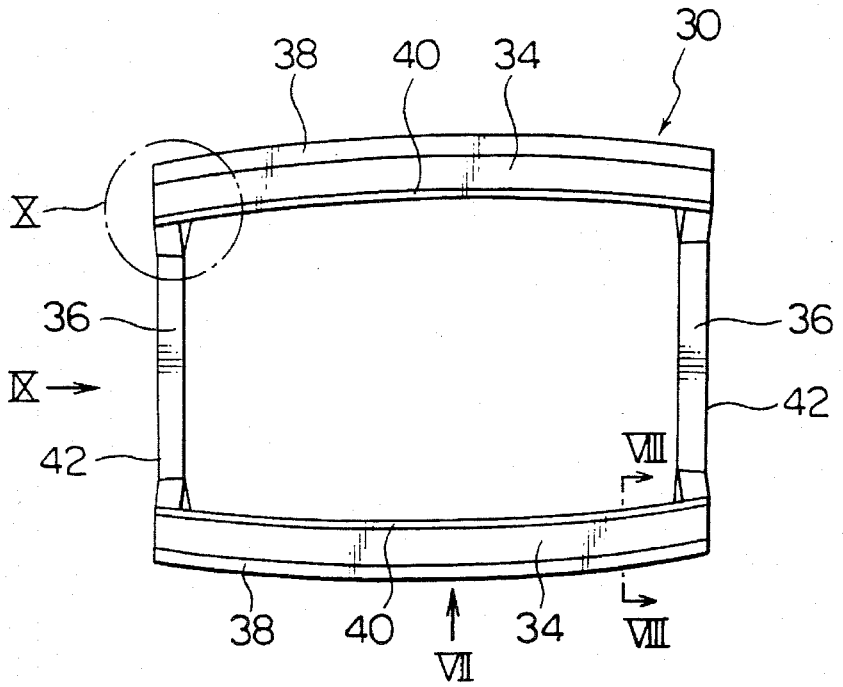
FIG. 5 is a plane view of the mounting frame shown in FIG. 4.
Figure 6:
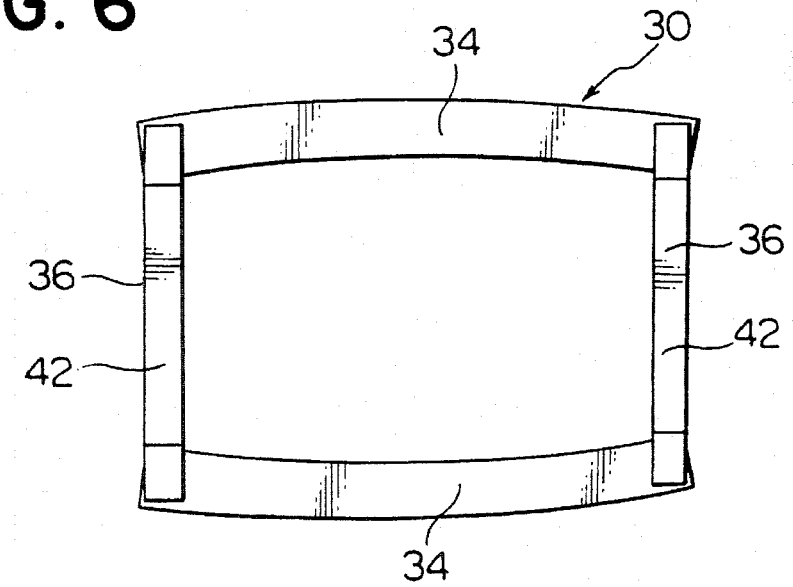
FIG. 6 is a rear view of the mounting frame shown in FIG. 4.
Figure 7:
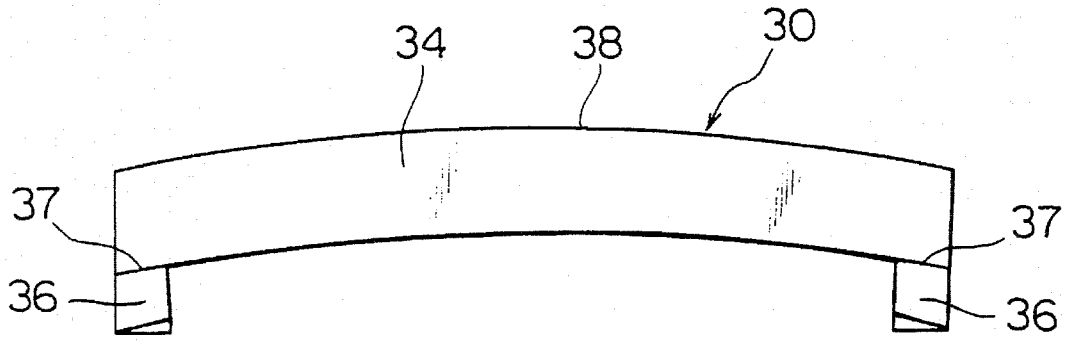
FIG. 7 is a side view of the mounting frame shown in FIG. 5 seen from the VII-direction.
Figure 8:
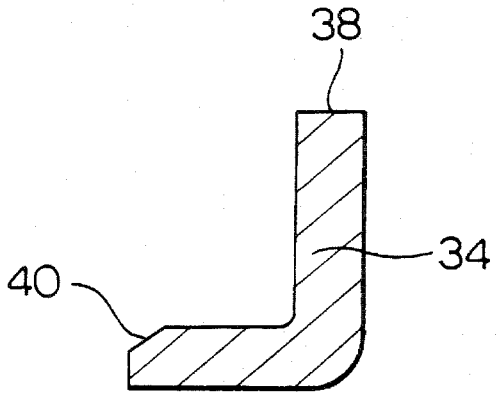
FIG. 8 is a sectional view of the mounting frame shown in FIG. 5 along line VIII—VIII.

At the bottom edge portions of the long members 34 there are formed single-sided tapers 40 of not more than 40 percent of the thickness of the long members 34. The lateral cross-section of the single-sided tapers 40 is shown in FIG. 8. The single-sided taper 40 is formed so as to avoid interference between the electron beams and bottom edge portions of the long members 34 when the electron beams pass through the apertures 12 of the color selecting electrode 10 from the rear side of the mounting frame 30 shown in FIG. 4. The long members 34, as shown in FIGS. 5 to 7, are bent to an arc shape as seen from the front side (same for rear side) and lateral sides along the shape of the inner surface of the panel glass of the CRT.

The two end portions of the short members 36 are joined by welding etc. to the bottoms of the two end portions of a pair of long members 34 disposed substantially in parallel. As shown in FIG. 7, the long members 34 are bent to an arch shape seen from the lateral sides as well. Therefore, at the two end portions of the short members 36 connected to those end portions there are formed slanted mating surfaces 37 by any of a twisting, crushing, or shaving process so as to enable a good mating with the bottom surfaces of the end portions of the long members 34.

Figure 9:
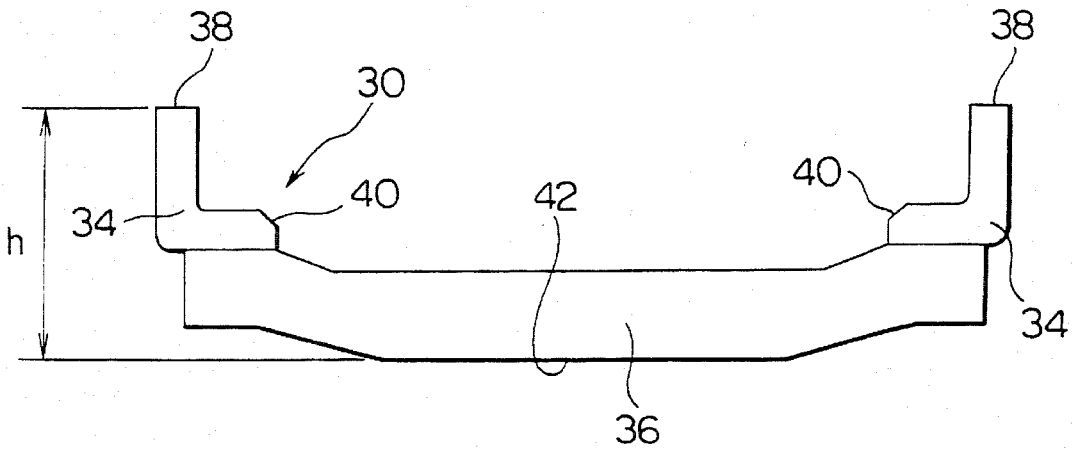
FIG. 9 is a side view of the mounting frame shown in FIG. 5 in the IX-direction.
Figure 10:
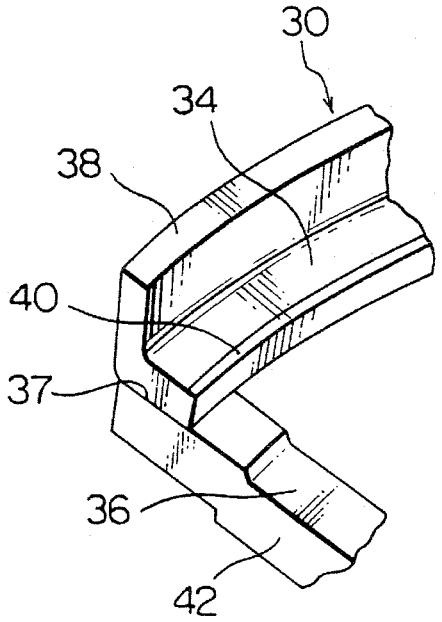
FIG. 10 is a detailed view of the connection portion (X portion) of the mounting frame shown in FIG. 5.

At the substantially center portions of the short members 36, as shown in FIG. 9, step-like projections 42 are formed. These step-like projections 42 are formed by pressing and bending the rod material constituting the short members 36. Such step-like projections 42 are formed so as to ensure a predetermined height "h" from the bottom surfaces of the projections 42 to the curved surfaces 38. The predetermined height "h" may be small in some cases depending on the type and size of the CRT. In this case, it is not necessary to form the step-like projections 42.

Next, an explanation will be made of the process for production of the color selecting electrode mounting frame according to this embodiment.

Figure 11:
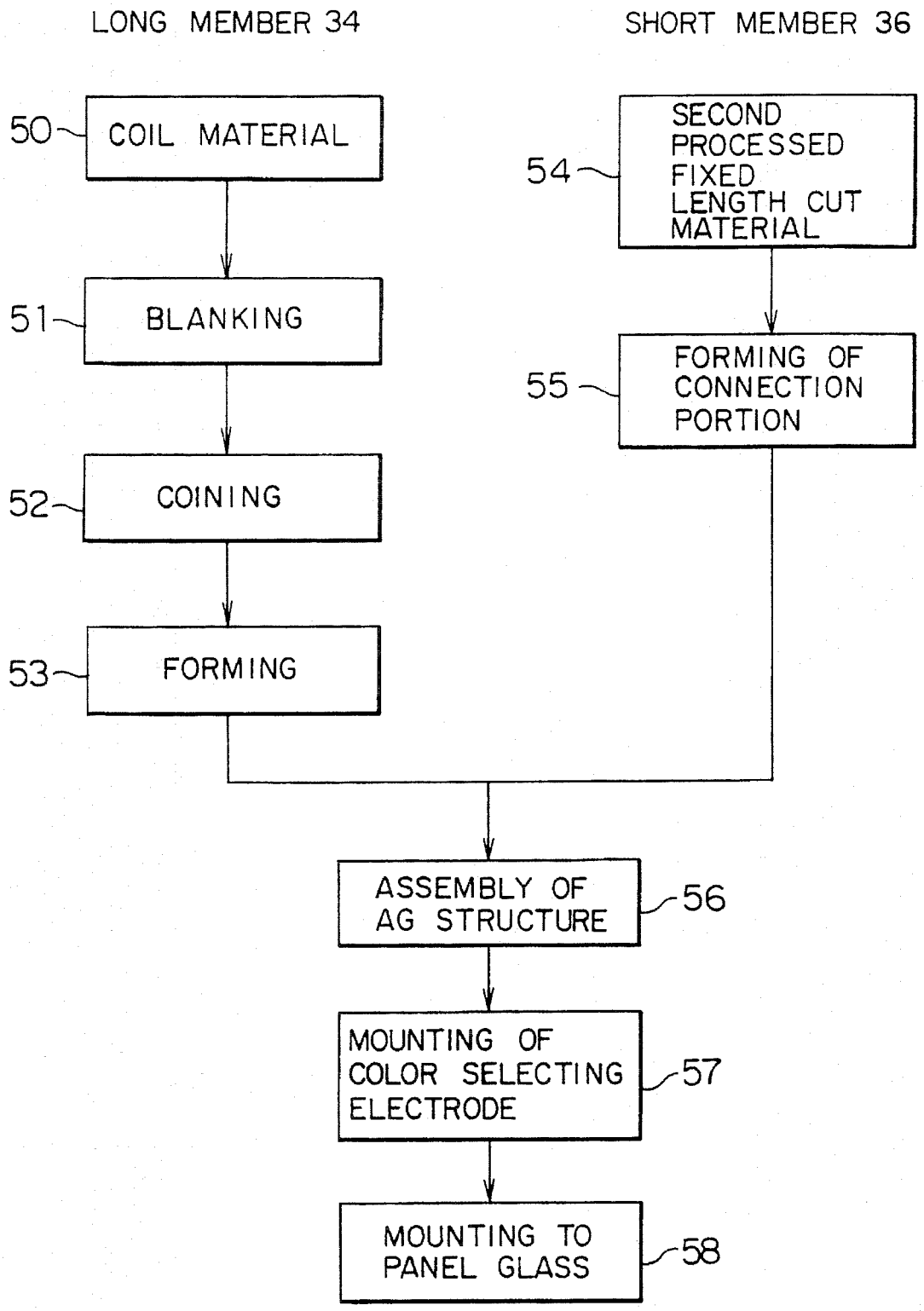
FIG. 11 is a flow chart of the steps of production of the mounting frame shown in FIGS. 4 to 10.

The overall flow of the process for production of the mounting frame 30 according to this embodiment is shown in 20 FIG. 11.

As shown in FIG. 11, long members are fabricated by the steps 50 to 53, the short members are fabricated by steps 54 to 55, and these are assembled in step 56.

First, an explanation will be made of the process for production of the long members 34.

Figure 13:
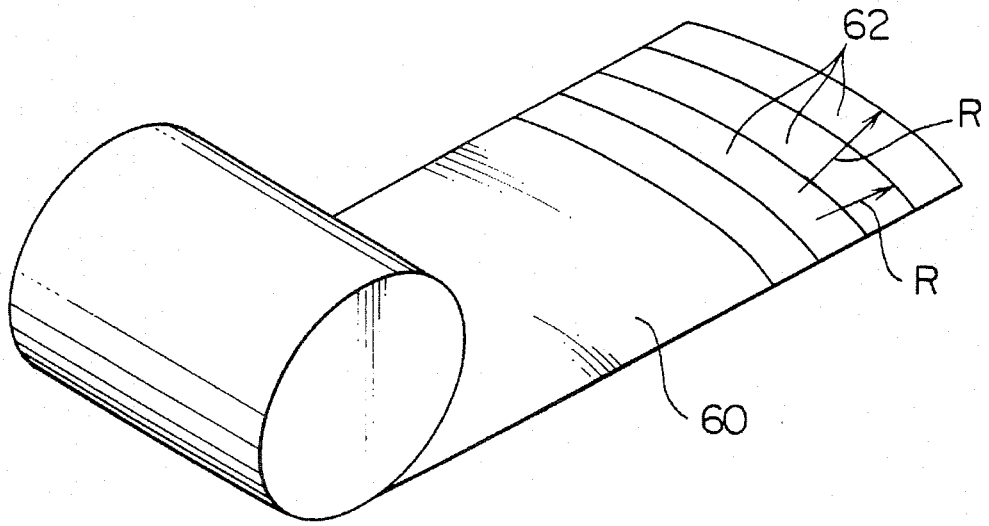
FIG. 13 is a perspective view of a coiled plate used for the blanking step shown in FIG. 12A.

At step 50, a coiled material is prepared for fabricating the long members 34. This coiled material, as shown in FIG. 13, consists of a plate 60 of a predetermined width wound in a coil shape. The width of the plate 60 is determined by reverse calculation from the length of the finished product long members 34.

Figure 12A:
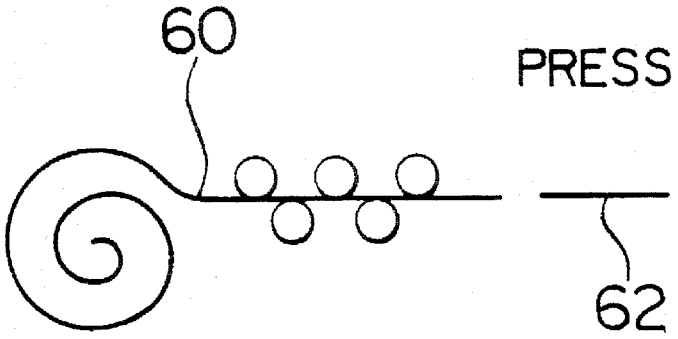
FIG. 12A and 12B are schematic views showing the steps of production of the long members of the mounting frame.

Next, at step 51 shown in FIG. 11, the end portion of the coil shaped plate 60 shown in FIG. 12A and FIG. 13 is successively blanked to obtain the arc-shaped members 62 for the long members. As shown in FIG. 13, the curvatures R of the arc-shaped cutting lines of the arc-shaped members 62 are all identical and are determined by reverse calculation from the curvature of the finished product long members. The cut width of the arc-shaped member 62 is determined by reverse calculation from the width of the L-sectional shaped long members.

Next, at step 52 shown in FIG. 11, coining is performed to form the single-sided tapers 40 of the long members 34 shown in FIG. 8. The single-sided tapers 40 formed by this coining have a size of not more than 40 percent of the thickness of the long members 34.

Figure 12B:
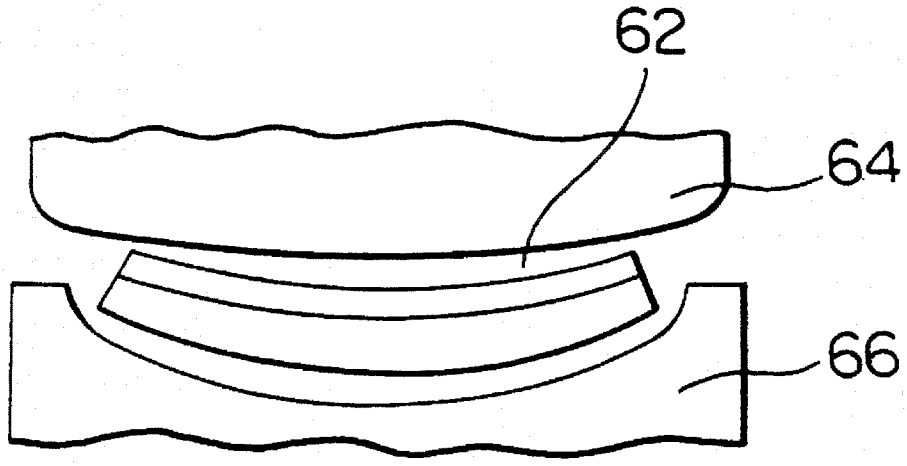

Next, at step 53 shown in FIG. 11, forming is performed. In this forming process, as shown in FIG. 12B, the member is set between the punch 64 and die 66 and the punch is pressed in the direction of the die 66 so as to bend the arc shaped member 62 to an L-sectional shape and, as shown in FIGS. 5 to 7, to give a curvature so as to give an arc shape seen from the front side and the lateral side and thereby obtain a long member 34. After the forming process, the bent portion may be embossed to suppress springback due to the processing.

On the other hand, when fabricating the short members, first, at step 54 shown in FIG. 11, a material obtained by cutting a rectangular section rod material into fixed lengths is prepared. The cutting length is determined by reverse calculation from the length of the finished product short members 36.

Next, at step 55 shown in FIG. 11, the two end portions of the rod shaped material for forming the short members 36 are processed to match the curvature of the two end portions of the long members 34 so as to form the slanted mating surfaces 37 as shown in FIG. 7. This is to improve the mating of these members 34 and 36. As the means for processing the two end portions of the rod shaped material for forming the short members 36 to match the curvature of the two end portions of the long members 34, use may be made of any of a twisting process, crushing process, and shaving process or combinations of the same.

Figure 4:
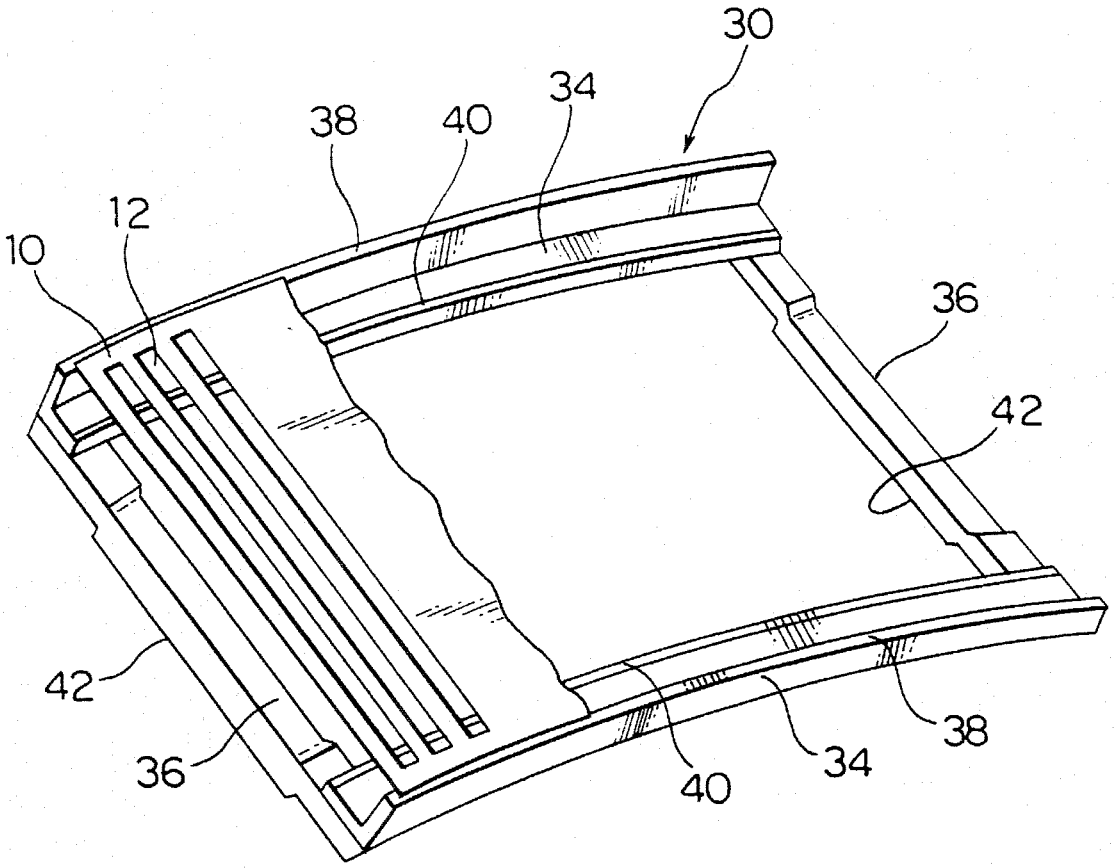
FIG. 4 is a schematic perspective view of a color selecting electrode mounting frame of a CRT according to an embodiment of the present invention.

As shown in FIG. 4 and FIG. 9, when forming the step-shaped projections 2 at the approximate center portion of the short members 6, use is made of the press or rolling process. This processing is performed at the same time or before or after step 55 shown in FIG. 11.

After the long members 34 and short members 36 are fabricated by steps 50 to 53 and steps 54 and 55, these members 34 and 36 are joined as shown in FIGS. 4 to 10 by TIG welding, for example, at step 56 to assemble the color selecting electrode mounting frame (AG structure).

Next, annealing is performed to release strain and shot blasting performed to remove the oxide film. Next, as shown in FIG. 4, a curved surface 38 with superior smoothness is formed by NC milling etc. at the top edge portion of the long member 34.

After this, deburring by a grinder etc., rustproofing, cleaning, and other processes are performed, then a holder portion is welded to the color selecting electrode 30 for attachment to the CRT. Next, at step 57 shown in FIG. 11, the two side positions of the color selecting electrode 10 shown in FIG. 4 are attached to the curved surfaces 38 of the long members 34 by seam welding. The color selecting electrode 13 is affixed by seam welding in a state mounted with a predetermined pressure so that it will not loosen. After the welding, trimming and other post-processing are performed.

Next, at step 58 shown in FIG. 11, the color selecting electrode mounting frame 30 with the color selecting electrode 10 joined to it is attached to the inner surface of the panel glass of the CRT through springs or dampers.

In the process for production of the color selecting electrode mounting frame 30 according to the present invention, use is made of a coiled plate 60, so storage and transport are easy. The coiled plate 60 is an inexpensive general use material, so the material is easy to procure and the time in inventory can be shortened.

The width of the plate 60 is determined by reverse calculation from the length of the finished process long members after the forming process. Accordingly, there is no need to cut off unnecessary portions of excess length after the forming process and there is no waste of material.

Further, in the process for production of this embodiment, when fabricating the short members 36, there is no need for bending to a substantially U-shape. A step-shaped projection 42 is formed by pressing, rolling, etc., so the material can be cut to a length roughly the same as the finished short members 36. Therefore, there is no need to cut off and remove unnecessary lengths in a later step and there is no waste of material.

Further, at the end portions of the short members 36 according to this embodiment, the slanted surfaces 37 for joining with the long members 34 are formed by twisting process or the shaving process, so compared with the prior art in which slanted mating surfaces for joining are formed by cutting, the precision of the slanted mating surfaces is improved and the processing work becomes extremely easy.

Next, an explanation will be made of a color selecting electrode mounting frame according to a second embodiment of the present invention.

Figure 14:
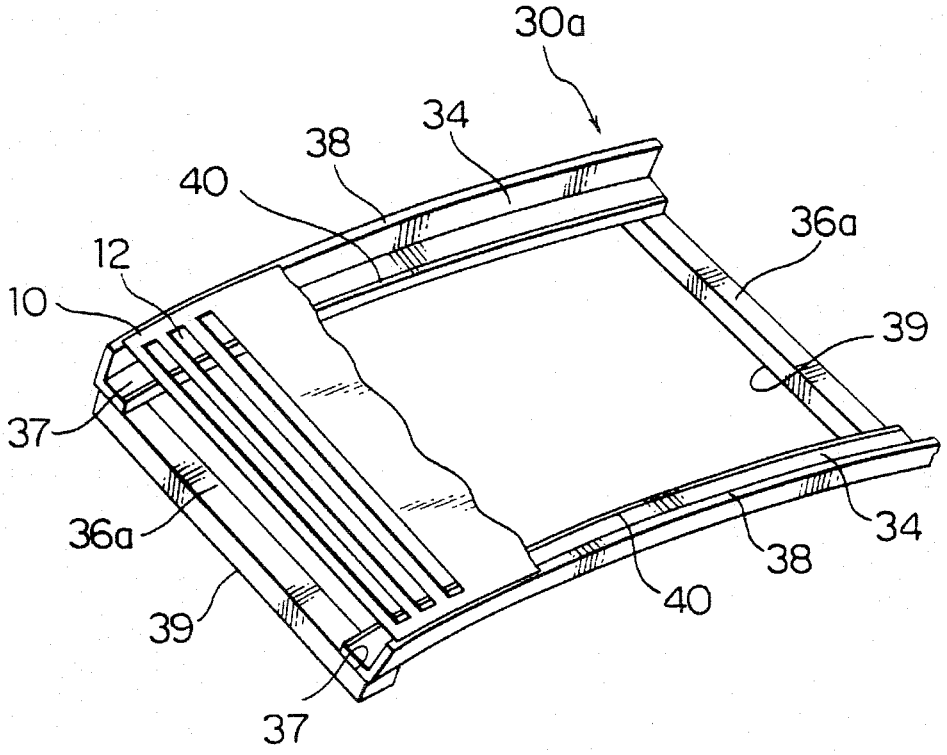
FIG. 14 is a schematic perspective view of a color selecting electrode mounting frame of a CRT according to another embodiment of the present invention.

As shown in FIG. 14, in the color selecting electrode mounting frame 30 according to this embodiment, for the long members 34, use is made of a similar member as the first embodiment shown in FIG. 4 to FIG. 13. The constitution of the short members **36*a*** differs from that of the first embodiment. In this embodiment, the same references are given to members common with the first embodiment and explanations thereof are omitted.

The short members **36*a* of the present embodiment differ from the short members 36 used in the first embodiment in that no step-shaped projections are formed at the bottom surfaces 39 of the same. The short members 36*a* are fabricated by cutting a rod material of a rectangular cross-section (circular or other shapes also possible) into predetermined lengths and subjecting the two end portions of the materials to a twisting process or shaving process to form the slanted mating surfaces 37**.

The color selecting electrode mounting frame **30*a* of this embodiment and the process for production of the same have similar actions to those of the above-mentioned first embodiment. Also, no step-like projection is formed at the bottom surface 39 of the short members 36*a*. Therefore, when fabricating the short members 36*a***, there is no need for pressing and bending for forming the step-shaped projections and the manufacture becomes further easier.

Next, an explanation will be made of a fourth embodiment of the present invention.

Figure 15:
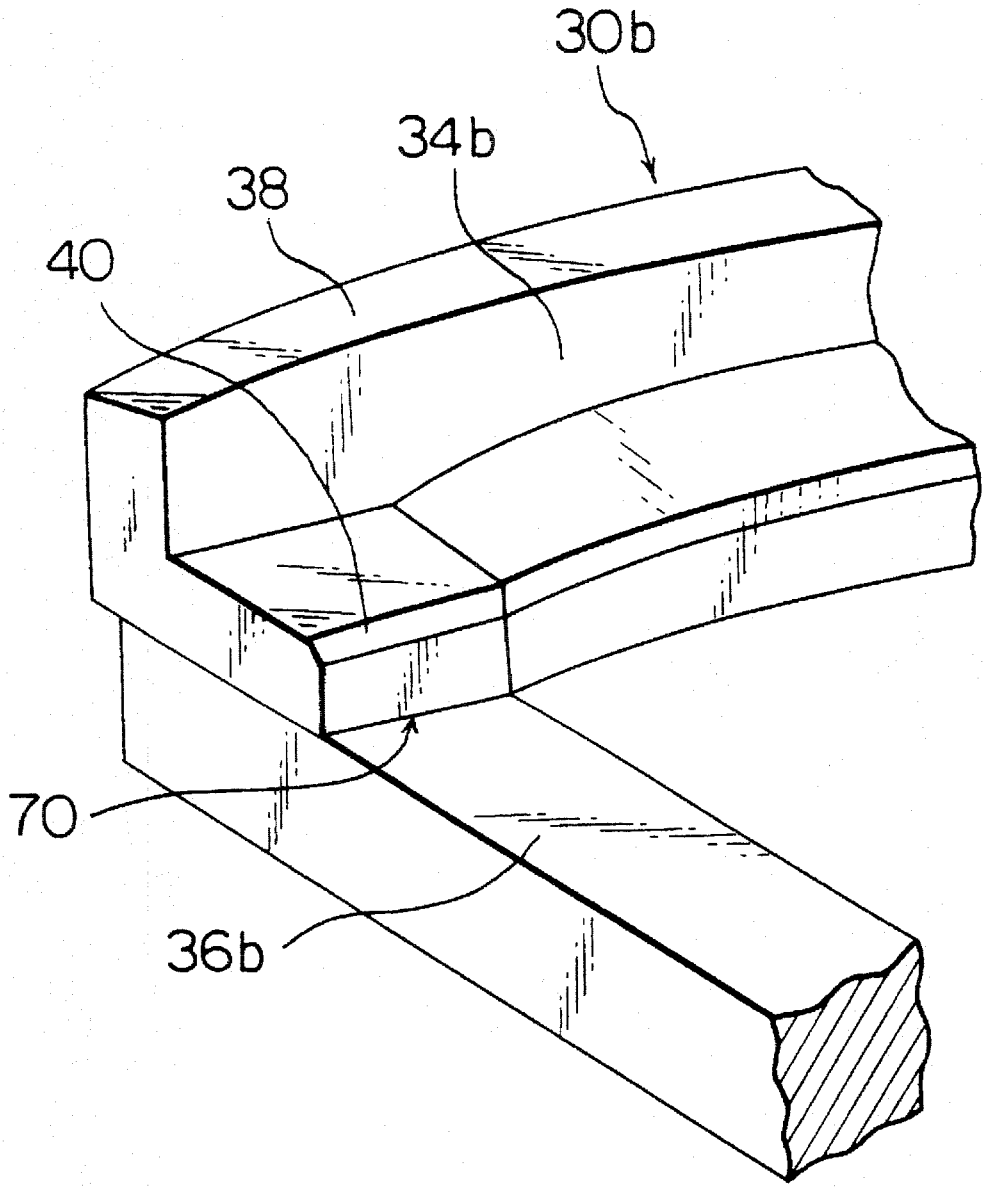
FIG. 15 is a schematic perspective view of a color selecting electrode mounting frame of a CRT according to another embodiment of the present invention.

As shown in FIG. 15, in the color selecting electrode mounting frame **30*b* according to this embodiment, the end mating portions of the long members 34*b* are crushed so that the bottom surfaces 70 of the end portions of the long members 34*b*** become flat. This crushing is preferably performed at the same time as the bending to the L-sectional shape by pressing from the arc shaped material obtained by blanking from a rolled plate, but may also be performed in a separate step.

By making the bottom surfaces 70 of the end portions of the long members **34*b* flat, it becomes possible to use as is straight materials without performing the above-mentioned bending, twisting, crushing, shaving process, etc. on fixed length materials of a rectangular cross-section (circular or other shapes also possible). Therefore, the production of the color selecting electrode mounting frame 30*b*** becomes even easier.

Note that in this embodiment, members common with the first embodiment and third embodiment described above are given the same references and explanations are omitted.

Note further that the present invention is not limited to the above embodiments. Various modifications may be made within the scope of the invention.

As explained above, according to the present invention, the waste of material is eliminated, the processing and assembly of the long members and short members constituting the color selecting electrode mounting frame become extremely easy, and, as a result, the costs of production can be greatly reduced. More specifically, costs can be reduced at at least about 20 percent.

Further, in particular, it becomes possible to use a coiled plate as the material for producing the long members, so storage and transport become extremely easy. In addition, a coiled plate is an inexpensive, general use material, so procurement of materials becomes easy and the inventory period can be shortened.

What is claimed is:

1. A color selecting electrode mounting frame for a CRT comprising:

a pair of long curved members each having an L-shape cross-section, each of said L-shaped cross-sectioned long curved members having an upright portion and a horizontally extending leg portion, the upright portions having curved top edge portions to which two opposing sides of a color selecting electrode are attached, said horizontally extending leg portions being arranged to extend toward each other and to each have a taper portion formed along an upper edge of each free end thereof; and a pair of short members which are arranged to extend between said pair of long members, said short members each being each formed from a straight piece of rod material so as to have aligned end portions which extend laterally outward in a direction essentially parallel to the central portion, said laterally outward extending end portions being joined to two ends of said long members, each of said L-shaped cross-sectioned long curved members being obtained by blanking a plate of a fixed predetermined width into an arc shape having a predetermined curvature, and subsequently forming it to have the L-shaped cross-sectional shape and curvature which matches a panel glass surface of the CRT.

2. The color selecting electrode mounting frame for a CRT as set forth in claim 1, wherein said taper portions are not more than 40 percent of the thickness of the long members.

3. The color selecting electrode mounting frame for a CRT as set forth in claim 1 or claim 2, wherein said step-like projections adjust the heights of the long curved members.

4. The color selecting electrode mounting frame for a CRT as set forth in claim 1 or claim 2, wherein the two end portions of said short members are processed to match the curvature of the two end portions of said long members.

5. The color selecting electrode mounting frame for a CRT as set forth in claim 4, wherein the end portions of said short members are processed to match the curvature of the two end portions of said long members by any one of a twisting, crushing, and shaving process.

6. The color selecting electrode mounting frame for a CRT as set forth in claim 1 or claim 2, wherein the mating surfaces of said long members with the short members are crushed so as to become flat surfaces and wherein the two end portions of said short members are flat surfaces.

* * * * *